United States Patent [19]

Mogol et al.

[11] Patent Number: 4,637,372

[45] Date of Patent: Jan. 20, 1987

[54] SIMULATED LOG-BURNING FIREPLACE

[76] Inventors: Gerald M. Mogol, 2169 Edgecumbe Rd., St. Paul, Minn. 55116; Leo E. Fox, 357 Stonebridge Blvd., St. Paul, Minn. 55105

[21] Appl. No.: 302,039

[22] Filed: Sep. 14, 1981

[51] Int. Cl.[4] ..... F24C 3/00

[52] U.S. Cl. ..... 126/127; 431/125; 431/152

[58] Field of Search ..... 126/127, 252, 256, 254, 126/265, 262, 79, 152 B, 152 R; 431/125, 150, 152, 331, 332

[56] References Cited

U.S. PATENT DOCUMENTS

| | | | |
|---|---|---|---|
| 2,306,467 | 12/1942 | Reynolds | 431/152 X |
| 3,277,882 | 10/1966 | Rose | 126/127 |
| 3,382,861 | 5/1968 | Peterson | 126/127 X |
| 3,817,686 | 6/1974 | Quittner | 431/125 |
| 3,831,582 | 8/1974 | Mahoney | 126/127 X |
| 3,993,430 | 11/1976 | Forker | 431/331 X |

*Primary Examiner*—Larry Jones

*Attorney, Agent, or Firm*—Jacobson and Johnson

[57] ABSTRACT

A thin, box-like, open-topped burner holds liquid fuel and has an attached platform support for an imitation, non-combustible log located behind and at the top of the burner with a filling tube in liquid communication with the burner and a set of lever arms linked together arranged to close off the top of the burner when access to the filler tube is permitted and to prevent access to the filler tube when the top of the burner is open.

2 Claims, 4 Drawing Figures

SIMULATED LOG-BURNING FIREPLACE

BACKGROUND OF THE INVENTION

1. Field of the Invention

This invention is to provide a simulated log-burning fireplace. Because of the nature of its construction, optionally it can be inserted in an existing fireplace or can be enclosed in a suitable structure for use anywhere in a room. The burners are arranged with respect to the artificial non-combustible logs so as to give the appearance of a flame that is consuming the log. The burners contain liquid fuel which is inserted via a filling tube. In a preferred embodiment, a safety feature is added by providing a mechanical linkage of arms between the filler tube and the burners which can be moved so that when the filler tube cap is removed to insert fuel into the filler tube, the open top of the burner will be closed off and after the fuel has been added and the filler tube cap replaced, further access to the filler tube is prevented and the top of the burner is opened to permit the fuel to be ignited.

2. Description of the Prior Art

A type of simulated log burner which utilizes liquid fuel is shown in U.S. Pat. No. 3,817,686. In the '686 patent the fuel tank is hidden from view and a fuel line extends to burners supported under and in front of the imitation non-combustible logs and the flame from the burners give the appearance of a log-consuming fire. Another simulated fireplace system is shown in U.S. Pat. No. 4,076,490 which illustrates an imitation, non-combustible log having recesses or cavities for holding the liquid fuel and when the fuel is ignited it gives the appearance of a flame springing directly out of the artificial log. Each of these previous devices and others of a similar nature have numerous drawbacks. One is that they do not authentically reproduce the illusion of an actual wood-burning fireplace. Another, in the case of the recessed log, is the absence of a means for extinguishing the fire except by extinguishing the flame in each of the separate recesses. Also, there is the danger of fuel spillage if the log should be tilted or tipped. In the case of the '686 patent means must be provided to hide the fuel tank and the burners from the viewer and additionally the individual burners might become clogged.

Another device is shown in U.S. Pat. No. 3,993,430 which is a hollow perforated ceramic log where the fuel is contained within the log itself. This also has the disadvantage of not realistically simulating a log-burning fireplace and the further disadvantage of being difficult to extinguish. Also, since the log contains the burning fuel, the log is likely to become hot and difficult if not impossible to handle before it has cooled off. It cannot be refilled with fuel for some time after the burning has been completed.

SUMMARY OF THE INVENTION

A relatively thin box-like burner having a width approximating that of the length of a fireplace log has an open top and contains liquid fuel. A platform or support is provided behind near the top of the burner on which a non-combustible imitation log rests. The burner chamber is filled with fluid via a filling tube in communication with the burner. When the fuel is ignited, the flame coming out the top appears to be consuming the log. A fuel is used which provides an attractive, luminous flame. Closures are provided to close off the top of the burner when desired. As a feature of the invention, a mechanism is provided to prevent access to the filler tube when the burner top is opened and to close off the top of the burner when access to the filler tube, to insert more fuel, is permitted. The device is very stable in construction so there is virtually no danger of tipping over and fuel spilling out. An additional feature is the provision of recesses or openings on the support for the imitation logs whereby the logs can be suitably located and kept in place.

DESCRIPTION OF THE PREFERRED EMBODIMENT

Figure 1:
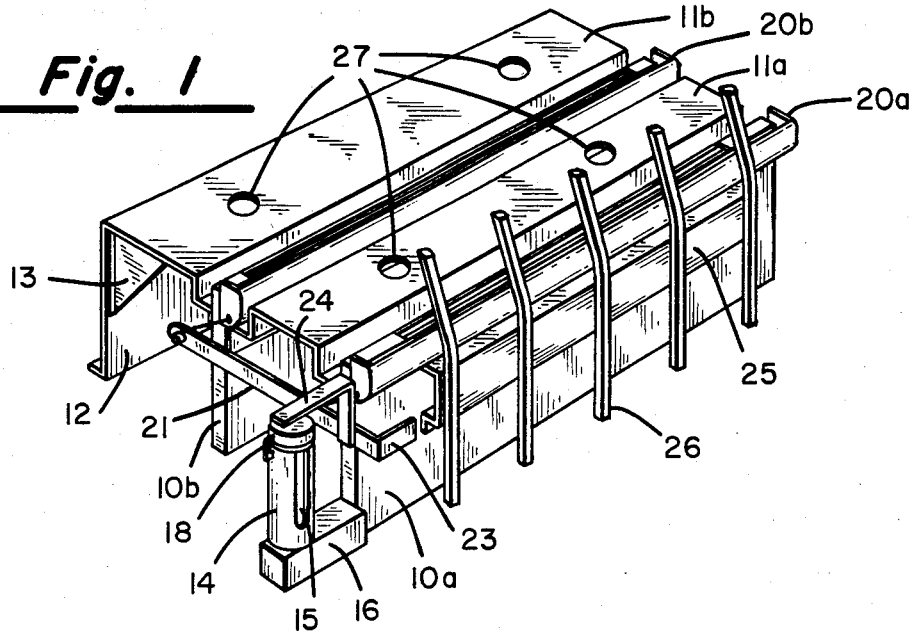
FIG. 1 is a front left perspective view of a preferred embodiment of the invention.

A pair of thin but wide box-like burners 10*a* and 10*b* for holding liquid fuel are closed at all sides but open along the top. The width of the burner elements 10 is selected to approximate the length of a conventional fireplace log so as to most closely simulate a log-burning fireplace. The burners 10 must be constructed out of a rigid material for stability and must not be combustible nor be damaged by flame. Typically, no limitation being intended, the burners may be made out of 18 gauge cold rolled steel and measure about 20 inches in width, about one-half inch in depth and approximately six inches high. Attached to the rear of the front burner 10*a* in any convenient fashion, such as by welding, and extending rearward therefrom to the front of the rear burner 10*b* is a flat support or platform 11 which is also made of a rigid non-combustible material to support an imitation non-combustible log, not shown. In a similar fashion a second support 11*a* is attached to the rear of burner 10*b* and extends rearward therefrom for a similar purpose. The support members 11 are attached to the burners near but slightly below the top of the burners and have an upward 90 degree jog so that the platform on which the imitation log sets is at about the same height as the top of the burners. This more realistically simulates a log-burning fireplace since the flame comes out the top of the burners 10 and the relation of the flame to the log accurately simulates what takes place in an actual wood-burning fireplace. A downward extending panel 12 is attached to or is a continuation of the platform 11*b* and provides a rear support for the device. A triangular brace 13 is also attached, such as by welding, to provide additional strength and structural support.

Fuel is inserted into the burners 10*a* and 10*b* through a filler tube 14 which has a plexiglass covered viewing area 15. The filler tube 14 is in fluid communication with the front burner 10*a* through a conduit 16 and the front burner 10*a* is in fluid communication with the rear burner 10*b* through a conduit 17. The filler tube 14 has a conventional cap 18.

Figure 2:
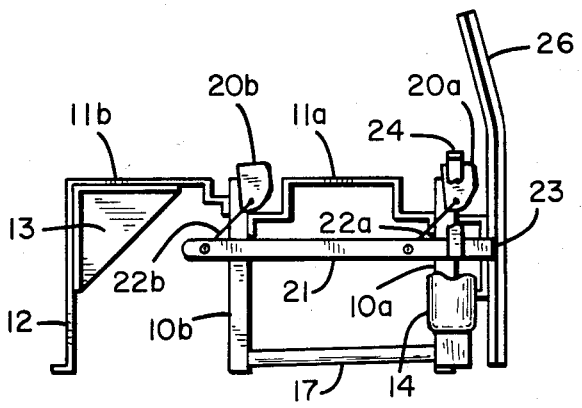
FIG. 2 is a left side elevational view showing the burner covers open.
Figure 3:
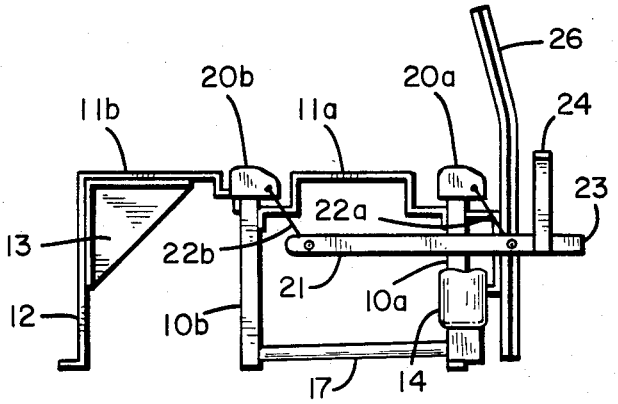
FIG. 3 is a left side elevational view showing the burner covers closed.
Figure 4:
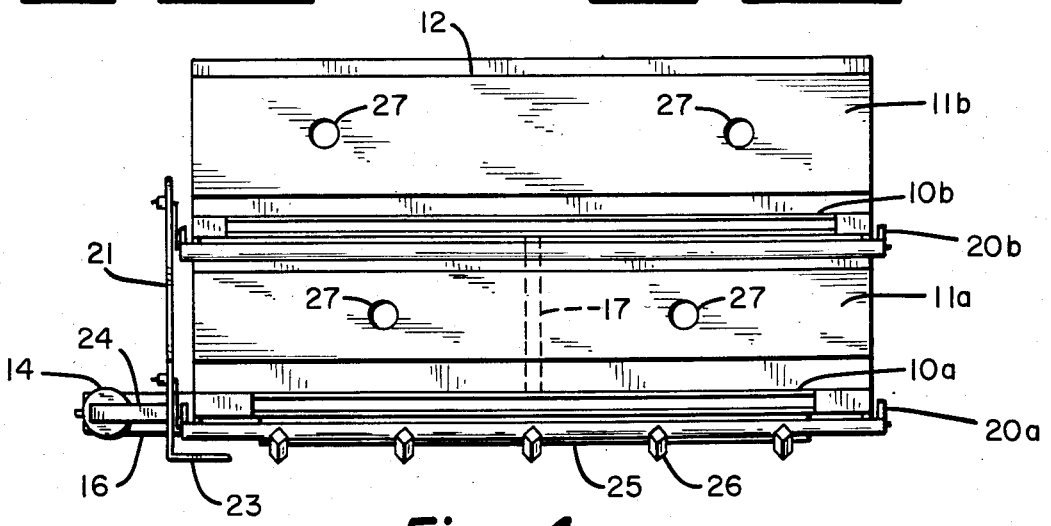
FIG. 4 is a top plan view of the embodiment illustrated in FIG. 1.

Pivotally attached in some convenient fashion near the top of the burners 10*a* and 10*b* are closures or covers 20*a* and 20*b* respectively. The closures are identical and have a general U-shape or channel shape in cross section. The covers 20 can be swung to open the tops of the respective burners 10 as illustrated in FIGS. 1, 2 and 4 or can be swung to close the tops of the burners as illustrated in FIG. 3. An elongated arm 21 extends rearward from the front of burner 10*a* toward burner 10*b* and is linked to each of the covers 20*a* and 20*b* by pins 22*a* and 22*b* respectively. The front end of arm 21 has an angulated handle 23 which can be grasped by the user to move arm 21 rearward and forward to correspondingly swing the covers 20 to open and close the tops of the burners 10. Attached to and extending upward for a distance and then outward from arm 21 is a right angle arm 24. Arm 24 is constructed to rise vertically and extend outwardly such that when arm 21 is in a position such that the burners 10 are open, arm 24 prevents cap 18 on the filler tube 14 from being removed and when arm 21 is positioned so that the burners 10 are closed, there is access to the filler tube by permitting cap 18 to be removed.

Attached to the front of the front burner 10*a* is an angle bracket 25 which has attached to it in some convenient fashion, such as by welding, a set of upwardly extending and partially rearwardly angulated rods 26 which give the unit a better appearance as a wood-burning fireplace.

The platforms or supports 11 for the simulated logs contain locators, shown in the form of apertures 27, for the purpose of receiving projections or dimples on the imitation log, not shown, so as to position the logs and keep them in a position which best simulates a wood-burning fireplace. Other locating means, such as recesses, could be used. In addition, it is contemplated that the upper part of the logs which normally rest on platforms 11*a* and 11*b* may have recesses or slots or the like to act as position locators for a third imitation log which could be laid across the other two logs.

It is contemplated that the liquid fuel be basically methyl alcohol or methanol but in a mixture which will produce a bright yellow luminous flame instead of the non-luminous bluish flame which is normally produced by methanol. A feature of the device is that it provides relatively lengthy burning without refill. Typically, with each burner filled with 900 mls. or 0.24 gallon of liquid fuel so that the fuel is to within a quarter inch to three-eighths of an inch of the top of the burner, flame was produced for three hours and fifty minutes so that the average burn rate was about one-eighth of a gallon per hour without the logs.

Yet another feature is that no dangerous hot spots occur during the burning. It has been found under test with thermocouples placed at appropriate locations that the temperatures measured during three hours and fifty minutes of burn time were well within maximum allowable safety standards.

Although the described embodiment utilizes covers 20 which are pivotably swung to open and close the burners 10, it is contemplated that the mechanism could be easily modified so that sliding covers can be provided along with a sliding arm 24 for preventing access to the filler tube when the burners are open.

In addition, it has been found that the covers 20 can be used as dampers to control the size of the flame and the burning rate of the fuel. In addition, it is also contemplated that the top of the burners 20 can be at least in part closed off with a plate member, not shown in the drawings, having openings through which the fuel is ignited and through which the flames extend during burning. This permanent partial closure also has the effect of limiting the extent of the flame and reducing the burning rate of the fuel.

We claim:

1. A simulated log-burning fireplace for resting on a supporting floor, comprising:

elongated, open-top, rectangular, box-like burner means for containing liquid fuel, said burner means comprising at least two parallel spaced-apart box-like chambers;

support means located adjacent the top but not over the top of the burner means between said chambers for holding a non-combustible artificial log;

a filling tube connected to said burner means for filling said burner means with liquid fuel;

a cap on said filler tube;

a movable arm, said arm extended over said cap in one position for keeping the cap closed and removed from said cap in another position to permit the cap to be opened;

closure means located at the top of said burner means for closing the top opening of said burner means;

said burner means having a height substantially from the supporting floor to said log support means and a width substantially that of the length of an artificial log.

2. The invention described in claim 1 further including:

a second arm attached to said first arm;

means linking said second arm to the fuel chamber closure means such that when the first arm is moved to said one position said closure means is moved to open the top of the burner means and when the first arm is moved to said another position the closure means is moved to close the top of the burner means.

* * * * *